US009827603B2

(12) United States Patent
Eastwood et al.

(10) Patent No.: US 9,827,603 B2
(45) Date of Patent: Nov. 28, 2017

(54) METHOD AND APPARATUS FOR CLEANING

(75) Inventors: Michael Gervase Keith Eastwood, Hamilton (NZ); Michael Ian Powick, Hamilton (NZ)

(73) Assignee: 1M2 DESIGN LIMITED, Hamilton (NZ)

( * ) Notice: Subject to any disclaimer, the term of this patent is extended or adjusted under 35 U.S.C. 154(b) by 216 days.

(21) Appl. No.: 14/241,227

(22) PCT Filed: Aug. 30, 2012

(86) PCT No.: PCT/NZ2012/000152

§ 371 (c)(1), (2), (4) Date: Feb. 26, 2014

(87) PCT Pub. No.: WO2013/073961

PCT Pub. Date: May 23, 2013

(65) Prior Publication Data

US 2014/0190524 A1 Jul. 10, 2014

(30) Foreign Application Priority Data

Aug. 31, 2011 (NZ) ..... 594926

(51) Int. Cl.

| | |
|---|---|
| ***B08B 9/46*** | (2006.01) |
| ***B08B 9/093*** | (2006.01) |
| ***B08B 9/34*** | (2006.01) |
| *B08B 3/08* | (2006.01) |
| *B08B 9/08* | (2006.01) |
| *B28C 5/42* | (2006.01) |

(52) U.S. Cl.

CPC ..... *B08B 9/46* (2013.01); *B08B 9/093* (2013.01); *B08B 9/0933* (2013.01); *B08B 9/0936* (2013.01); *B08B 9/34* (2013.01); *B08B 3/08* (2013.01); *B08B 9/0817* (2013.01); *B28C 5/4203* (2013.01)

(58) Field of Classification Search

CPC ..... B08B 9/093; B08B 9/0936; B08B 9/34; B08B 9/46; B08B 9/08; B08B 9/0813; B08B 9/0933; B08B 3/08; B01F 15/00032

USPC ..... 134/22.1, 22.18, 24, 167 R, 168 R, 174, 134/198, 198 R, 167

See application file for complete search history.

(56) References Cited

U.S. PATENT DOCUMENTS

| | | | | |
|---|---|---|---|---|
| 6,354,439 | B1 * | 3/2002 | Arbore | B01D 29/05 209/353 |
| 6,418,948 | B1 * | 7/2002 | Harmon | B01F 15/00032 134/167 R |
| 6,640,817 | B2 | 11/2003 | Harmom | |
| 6,782,925 | B2 | 8/2004 | Raposo et al. | |
| 2007/0086270 | A1 * | 4/2007 | Harris | B08B 9/08 366/59 |

* cited by examiner

*Primary Examiner* — Saeed T Chaudhry

(74) *Attorney, Agent, or Firm* — Greer, Burns & Crain, Ltd.

(57) ABSTRACT

A method of cleaning a concrete bowl is provided including the steps of a) introducing water into at least one concrete bowl; b) collecting the water from the bowl after it has been used; and c) cleaning a concrete bowl by introducing at least some of the collected water into the bowl under pressure.

27 Claims, 6 Drawing Sheets

METHOD AND APPARATUS FOR CLEANING

This invention relates to a cleaning apparatus and method for containers of vessels.

In particular, the present invention has application to concrete bowl cleaning but this should not be seen as limiting.

BACKGROUND

When concrete is being mixed in the concrete bowl of a truck, it is common that drying concrete residue becomes stuck on the interior walls of the bowl. It is desired to remove tacky concrete for a number of reasons including minimising exposure to rust, damage to the walls of the bowl and decreasing available volume within the bowl.

Due to the fact that concrete hardens rapidly, this cleaning process is required on a reasonably regular basis to stop excessive build up of concrete residue.

Therefore a system to clean the concrete bowl in an efficient, effective, safe, and environmentally friendly way is desired.

Utilising water from a recycled supply for the removal of residual tacky concrete from bowls is common practice. However, these systems generally involve a water pipe dropping water into the back of the bowl with the bowl rotating to rinse the water throughout the bowl. No pressurized water is used Occasionally, a worker may also hold a water nozzle which distributes fresh water at mains supply pressure to remove this hardened concrete.

There are a number of disadvantages to these methods.

Firstly, these are slow and inefficient processes. Concrete bowls are generally reasonably large in size. The time required to discharge an effective amount of rinsing water and to rotate the bowl is lengthy. Also, the time it takes for the worker to apply the water nozzle to the interior surface area of a concrete bowl is lengthy.

Also due to the size of the concrete bowl, a large volume of water is required. Therefore this may not be the most efficient process in terms of time and water usage. The conventional method of dropping water into the truck bowl does not prevent significant accumulation of hardened concrete over time. Alternatively, the method of a worker holding a water nozzle which distributes fresh water at mains supply pressure uses a large volume of water, which is not very environmentally friendly.

A problem with a worker spraying water into the bowl is that there are certain 'blind spots' that cannot be cleaned due to the limited reach of the worker with his/her water nozzle. Most of the concrete bowls used in the industry today includes fins that protrude from the interior walls. It is difficult for the worker to apply the pressured water using these water nozzles to remove drying concrete behind these fins due to the reach or positioning of the worker. Also, because the method of cleaning is user operated, the chances of missing spots are high.

To remove hardened, cured concrete that may accumulate in the truck bowl over time, a worker is required to enter the truck bowl and use a pneumatic or electric jackhammer. There are obvious health and safety factors which may exist with this method with higher chances for injuries to workers as the equipment can be heavy, and fractured concrete may fall on the worker. This method may require the worker to undergo specialised training. Special rules will also apply to worker entering a confined space to meet Occupational Safety and Health (OSH) standards.

The invention described in New Zealand Application No. 583104 aims to overcome the above problems by introducing an automated system which means the user no longer has to enter the truck bowl and jackhammer concrete from the walls and fins. However, some major problems still subsists with the system disclosed in this patent document.

First, this system in practice is only used sporadically—not as an ongoing preventative program. This leads to concrete in the bowl accumulating and hardening between uses of the equipment.

Further, it still uses a large volume of water. Due to the large size of the concrete bowls, the amount of water required to clean the bowl is substantive.

The system operates at very high pressure, and any worn surfaces within the bowl may be damaged by the high pressure water spray.

Because this system utilises the mains water supply source it is still not environmentally friendly given the size of the concrete bowls.

Finally, this system still requires the worker to enter the concrete bowl after the cleaning process to check whether if cleaning was sufficient. Therefore the same confined space training and requirements still apply for OSH standards. It is an object of the present invention to address the foregoing problems or at least to provide the public with a useful choice.

All references, including any patents or patent applications cited in this specification are hereby incorporated by reference. No admission is made that any reference constitutes prior art. The discussion of the references states what their authors assert, and the applicants reserve the right to challenge the accuracy and pertinency of the cited documents. It will be clearly understood that, although a number of prior art publications are referred to herein, this reference does not constitute an admission that any of these documents form part of the common general knowledge in the art, in New Zealand or in any other country.

Throughout this specification, the word "comprise", or variations thereof such as "comprises" or "comprising", will be understood to imply the inclusion of a stated element, integer or step, or group of elements integers or steps, but not the exclusion of any other element, integer or step, or group of elements, integers or steps.

Further aspects and advantages of the present invention will become apparent from the ensuing description which is given by way of example only.

SUMMARY

According to one aspect of the present invention, there is provided a method of cleaning a concrete bowl including the steps of:

a) introducing water into at least one concrete bowl;
b) collecting the water from the bowl after it has been used;
c) cleaning a concrete bowl by introducing at least some of the collected water into the bowl under pressure.

According to another aspect of the present invention, there is provided an apparatus for cleaning a concrete bowl including a probe; and
recycling apparatus to collect and re-introduce the used water back into the concrete bowl via the probe; and
apparatus to supply pressure to the recycled water; and
a control system operable by the user.

A concrete bowl is understood to be a container or vessel used to mix, carry and transport concrete. While the term concrete bowl could include a stand-alone container or vessel in most embodiments of the present invention it will one that is configured to attach to or be part of a concrete truck.

In some embodiments, the concrete bowl can include charge hoppers which are situated at the rear end of the concrete bowl to aid charging/discharging of concrete of the concrete bowl.

Cleaning of a concrete bowl should be understood to be the removal of tacky, semi-hardened concrete residues (and any other detritus) from the interior wall of the bowl.

Preferably the concrete bowl can rotate about its centre axis. This rotation can be driven either by a motor or manually. The rotation speed can be controlled by a control system as per normal concrete truck operation.

Preferably, water is introduced into the concrete bowl via a probe. This water is used to remove residue concrete on the interior walls of the concrete bowl.

It is envisaged that the initial water may come from a mains water supply or reservoir.

In some embodiments the initial water may include at least some concrete bowl residue. An important part of the invention is that the water used to clean the bowls includes beneficial elements which come from water that has been used to clean a concrete bowl whether the same bowl or previous ones.

After the water is used, it is then collected and recycled by a recycling apparatus.

In a preferred embodiment the recycling apparatus includes a reservoir and conduits connecting the reservoir to the probe.

In some embodiments it is envisaged that the reservoir will be positioned underground so that used water drains there naturally under the influence of gravity.

Water may drain into the reservoir via channels or grids in the ground, after being discharged from the concrete bowl.

In alternate embodiments, water may be actively pumped from the bowl to the reservoir via conduits.

In another embodiment the reservoir also collects rain water as well as water tipped from the interior of the concrete bowl after a cleaning cycle.

The reservoir may be any water proof structure having sufficient volume and structural strength to enable the present invention, say a concrete, plastic, fiberglass or metal tank.

The collected water includes particles of the residue concrete acquired from the initial cleaning process. The inventor has found that this is advantageous as it creates an abrasive effect for cleaning purposes.

The high pH from the concrete residue (lime) may also have a cleaning effect. The differences between cleaning of interior walls by using normal water under pressure compared to recycled water under pressure is significant and will be illustrated in the Best Modes section.

The conduits may include any hollowed cross section piping and/or tubing that is adequate to withhold the pressurised fluid to be transferred. The cross-sections of these conduits are preferably of a sufficient size to allow water that include concrete residue to pass through without blockages.

The recycling process is the transfer of the collected water from the reservoir to the probe by a pressure apparatus via the conduits. The collected water is then re-introduced into the concrete bowl under pressure.

The pressure applying apparatus includes a pump. The pump may be any hydraulic pump, centrifugal pump or any other means to transfer fluid through conduits by pressure differential principles.

The probe is an elongated hollow member which carries water nozzles configured to introduce the water into the concrete bowls. The probe preferably is a straight member with constant cross section although this is not essential. The hollowed cross sectional area is sufficient in size to allow the recycled water which includes the concrete residue to pass without blockages.

The probe is insertable into the concrete bowl by an actuating mechanism which may include a fluid pressure, an electric, or a mechanical system.

In a preferred embodiment, the actuating means is a variable slow speed motor, such as an electric motor.

Preferably safety mechanisms such as a shear pin or fuse is used so that if the probe is obstructed by anything, the actuating mechanism will stop rather than burning the motor out.

The actuating mechanism controls the rate of insertion, the depth of insertion, the angle of insertion relative to the horizontal plane. The system links to a control system to be operated by the user.

It should be appreciated that concrete bowls have varying volumes, geometries and heights. Therefore it is important that this variability can be accounted for with the control system in combination with the actuating mechanism.

The probe is mounted on a support frame at a required height to allow the probe to be inserted into the concrete bowl.

In an alternative embodiment, the probe is mounted on a substantially elongated pedestal.

Preferably, the pedestal is well supported at the base so it withstands any necessary forces of the cleaning process.

In an alternative embodiment, the probe is a curved hollow member which carries water nozzles configured to introduce the water into the concrete bowls.

Preferably the curved probe is used for the concrete bowls having charge hoppers.

The straight probe version of the invention is difficult to insert into concrete bowls with charge hoppers, the charge hoppers create an angled and smaller access to the interior of the concrete bowl.

The curved probe allows for insertion of the probe into the concrete bowl via the access created by the charge hopper.

Preferably the curvature of the probe is such that the probe can be inserted into the concrete bowl with clearance from the charge hoppers, without physically moving the charge hoppers.

Preferably the length of the curved probe is between 4.5 m-6.5 m depending on truck requirements. This length appears to be suitable to work with most current truck bowl sizes.

Preferably the radius of the curvature of the curved probe is 7-10 m depending on truck requirements, so that the probe can access substantially all of the interior wall of the concrete bowl.

Preferably the curved probe is made from standard pipe. The preferred pipe is the standard 38 mm NB medium wall galvanized pipe screwed and socketed, as this is relatively easily accessible and cheap.

The probe may be circular or box section and the choice may depend on friction drive system. Rollers have more surface area to grip on box section so this may be more efficient. The decision can be a trade off between number of rollers and cost standard pipe vs manufacture of curved box section conduit.

Preferably the entry angle of the curved probe will be so that the probe will clear the charge hopper without having to physically raise or remove the charge hopper to facilitate improved access.

Preferably the entry angle of the curved probe is between 38-45 degrees to allow maximum access by the water nozzle on the probe to the interior walls of the concrete bowl.

Preferably the drive mechanism of the embodiment of the curved probe is a friction driver roller system incorporating a plurality of rollers. At least one of these rollers is fixed and the rest is floating in a self tightening system i.e. the grip around the pipe gets tighter as the load increases.

A friction drive is preferred as tooth system may get clogged with spray/wash residue. A tooth drive system could be used but may require a cleaning system to overcome clogging.

The ingress and egress speed of this curved probe is preferably around 0.95 m/min and within the range of >=0.4 m/min to <=1.5 m/min.

Preferably there is an actuating mechanism to control the angle of insertion of the curved probe. Such actuating mechanism can include a hydraulic ram, or electric motors or the like.

The probe preferably introduces water into the bowl via water nozzles.

In one embodiment the head includes a number of nozzles which spray the water onto the interior walls of the concrete bowl. Care is needed to ensure there is adequate coverage of this bowls walls and fins by the water. Thus preferably there are multiple nozzles (say three) angled in different directions. The angles of these nozzles may be adjustable.

Preferably, the probe includes a monitoring device configured near the concrete bowl-end of the probe to monitor the cleaning conditions of the concrete bowl.

The monitoring device is preferably any equipment that captures (as in records and/or views) visual signal.

The monitoring device may be connected to a display device near or at the central control system so the user can view the visual signal sent back from the monitoring device via the said display device.

In one embodiment the monitoring device is a camera having suitable durability in harsh environment.

The control system controls the movements of the individual components of the apparatus. The parameters are determined and controlled by the user. The parameters can include rotational speed of concrete bowl, ingress and egress speed of probe, pressure of water introduced by the probe, angle of the probe relative to the horizontal plane etc.

The pressure of introduced water is preferably more than 1 bar but less than 20 bar. Less than 2 bar is considered inadequate to remove tacky concrete from the truck bowl. More than 16 bar risks damage to worn surfaces within the truck bowl.

The preferred pressure of introduced water is approximately 5 bar.

The rotation speed of the concrete bowl is preferably greater than 2.5 rpm but less than 10 rpm.

Less than 2.5 rpm is considered inadequate as the water jet may not have come into contact with the total circumference of the truck bowl before the probe head continues its motion of ingress/egress.

More than 10 rpm is considered inadequate as any stream of water jet does not have long enough time in contact with a specific part of the bowl for the residue to be removed.

The preferred rotation speed of the concrete bowl is approximately 6 rpm.

The ingress and egress speed of insertion of the probe is preferably greater than 0.3 m/min but less than 1.6 m/min.

Less than 0.3 m/min is considered inadequate as the process must be completed in less than 15 minutes to comply with production scheduling for cleaning operations.

More than 1.6 m/min is considered inadequate as any stream of water jet does not have long enough time in contact with a specific part of the bowl for the residue to be removed.

The preferred ingress and egress speed of insertion of the probe is approximately 0.95 m/min.

In operation, a concrete truck backs up to the mounted probe. The bowl is rotated as the probe enters the bowl introducing water therein. Water from the bowl is discharged and collected into the reservoir supplying the probe and may be reintroduced into the bowl during subsequent cleaning cycles. The combination of abrasive, high pH water introduced under pressure via multiple nozzles effectively cleans the bowl.

It can be seen that the present invention has a number of advantages over the prior art.

- Having an automated system for cleaning and monitoring the cleanliness of the bowl gives significant safety advantages and reduces manual labour with the associated health and safety risks from entering a confined space and jack hammering hardened concrete;
- Recycled water has an additional cleaning effect to mains water;
- Reduction of mains water usage addresses significant environment concerns;
- No added chemicals are required;
- Reduced wear and tear on truck bowl integrity;
- Improved vehicle efficiency, the truck should be at tare weight when empty.
- Can be used with vehicles fitted with charge hoppers without having to physically raise or remove the charge hopper to facilitate improved access
- Enables trucks to be positioned relatively with respect to the clearing equipment.

BRIEF DESCRIPTION OF DRAWINGS

Further aspects of the present invention will become apparent from the ensuing description which is given by way of example only and with reference to the accompanying drawings in which.

DETAILED DESCRIPTION

Figure 1:
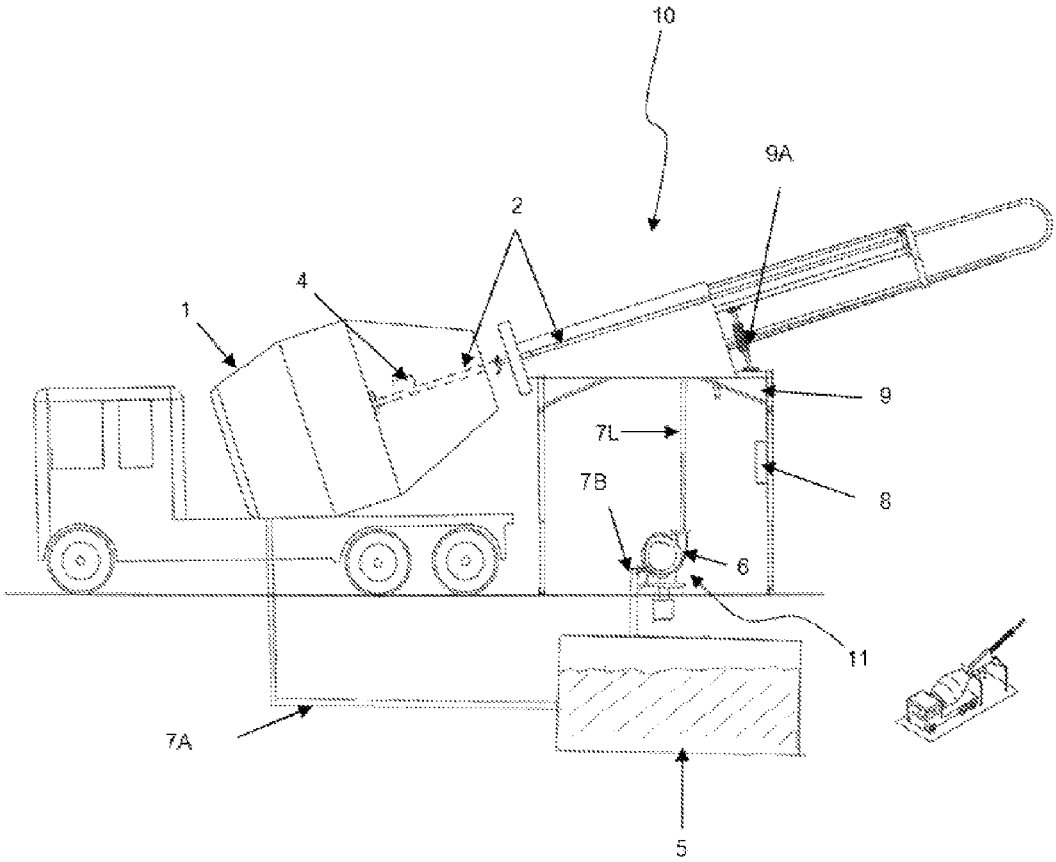
FIG. 1 illustrates a possible concrete bowl cleaning station set up.

A concrete bowl cleaning station set up is illustrated in FIG. 1.

The station set up includes a concrete bowl cleaning apparatus (10) for use with a concrete bowl (1).

The concrete bowl cleaning apparatus (10) includes a stand (9), a control system (8), a cleaning probe (2) and recycling apparatus (11).

The dotted line shows the probe (2) in its extended form.

The cleaning probe (2) is elevated by the stand (9) to a desired height to be inserted into the concrete bowl (1). The stand (9) is height adjustable. The pitch of the cleaning probe (2) is elevated to a desired pitch by a mechanical adjustment device (9*a*). This device may be actuated by a ram or screw, and either controlled by the control system (8) or adjusted manually.

The cleaning probe (2) has water nozzles (3) configured thereon to introduce the water into the concrete bowl (1).

The cleaning probe (2) also has a monitoring device in the form of a camera (4) positioned near its end so it can capture visual signals within the concrete bowl (1) and send this information back to the control system (8) to be processed.

The recycling apparatus (11) includes a reservoir (5), conduits for water transfer (7*a*, 7*b*), and a pressure applying apparatus in the form of a pump (6).

The reservoir (5) has an inlet connected to the interior of the concrete bowl (1), and an outlet connected to the probe (2).

After the water is used in the concrete bowl (1) it is drained to the reservoir (5) via conduits (7*a*). The pump (6) then transfers the collected water to the probe (2) via conduits (7*b*). In an alternate embodiment, the used water is tipped into the reservoir (5) instead of drained via conduits (7*a*).

The control system (8) is connected to the concrete bowl (1), the probe (2) and the pressure applying means (6) to control their parameters. Parameters controlled include the rotation speed of the concrete bowl (1), the insertion speed and distance of the probe (2), the pressure of which the water is introduced into the concrete bowl (1). The control system (8) also has a display device for users to monitor the visual signals sent back from the monitoring device (4).

Figure 2:
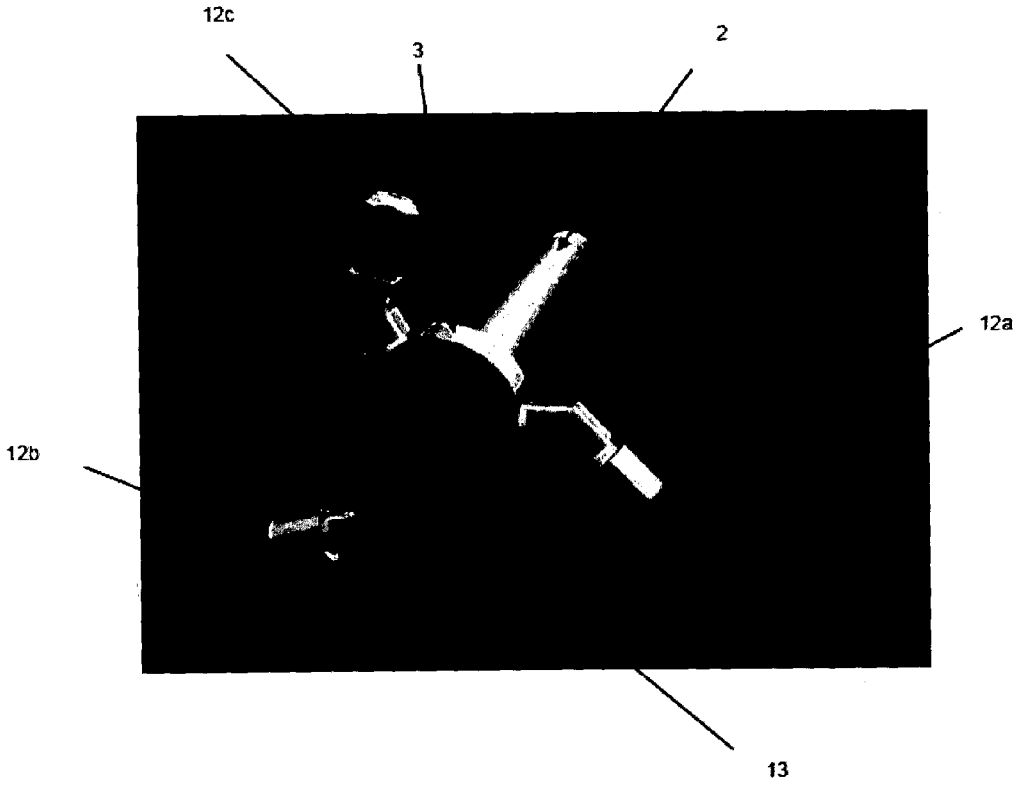
FIG. 2 illustrates a detailed view of one embodiment of the water nozzles.

FIG. 2 illustrates the water nozzle (3) positioned near the end of the probe (2).

The water nozzle (3) includes a manifold (13) and three nozzle heads (12*a*, 12*b* & 12*c*). The nozzle heads are joined by the manifold so the water gets fed from the probe (2) through to the manifold (13), then evenly distributed to each nozzle head (12*a*, 12*b* or 12*c*) at a constant pressure. The nozzle heads (12*a*, 12*b*, & 12*c*) are adjustable so the angle of the water jets from the nozzle heads can be altered.

Figure 3:
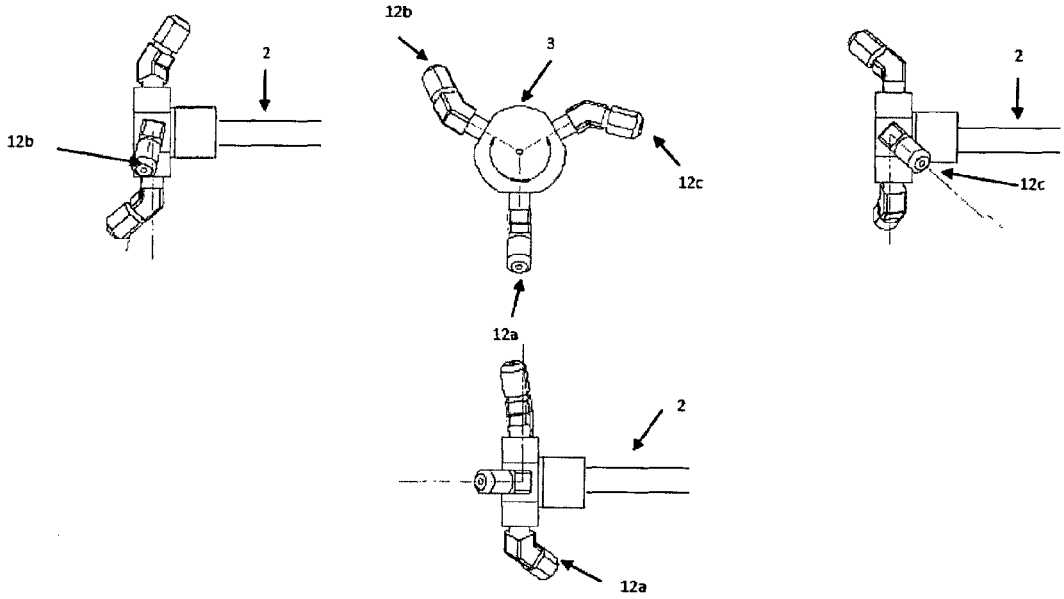
FIG. 3 illustrates a further detailed view of nozzle heads of FIG. 2.

FIG. 3 illustrates the angles of the three nozzles heads (12) relative to the normal plane of the longitudinal axis of the probe (2).

The first nozzle head (12*a*) is 45 degrees relative to the normal plane of the longitudinal axis of the probe (2).

The second nozzle head (12*b*) is 12 degrees relative to the normal plane of the longitudinal axis of the probe (2).

The third nozzle head (12*c*) is 48 degrees relative to the normal plane of the longitudinal axis of the probe (2).

Figure 4A:
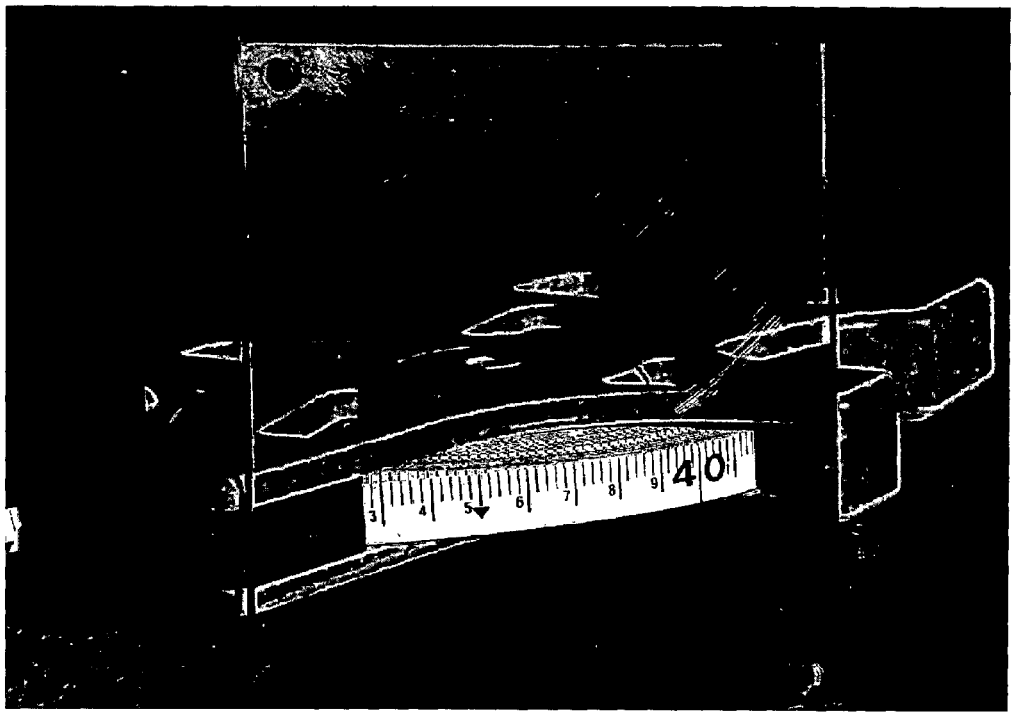
FIG. 4*a* illustrates the abrasive effect of mains fresh water supply.

FIG. 4*a* illustrates an acrylic plate after 30 minutes of continuous application of pressurised water from the mains water supply.

Figure 4B:
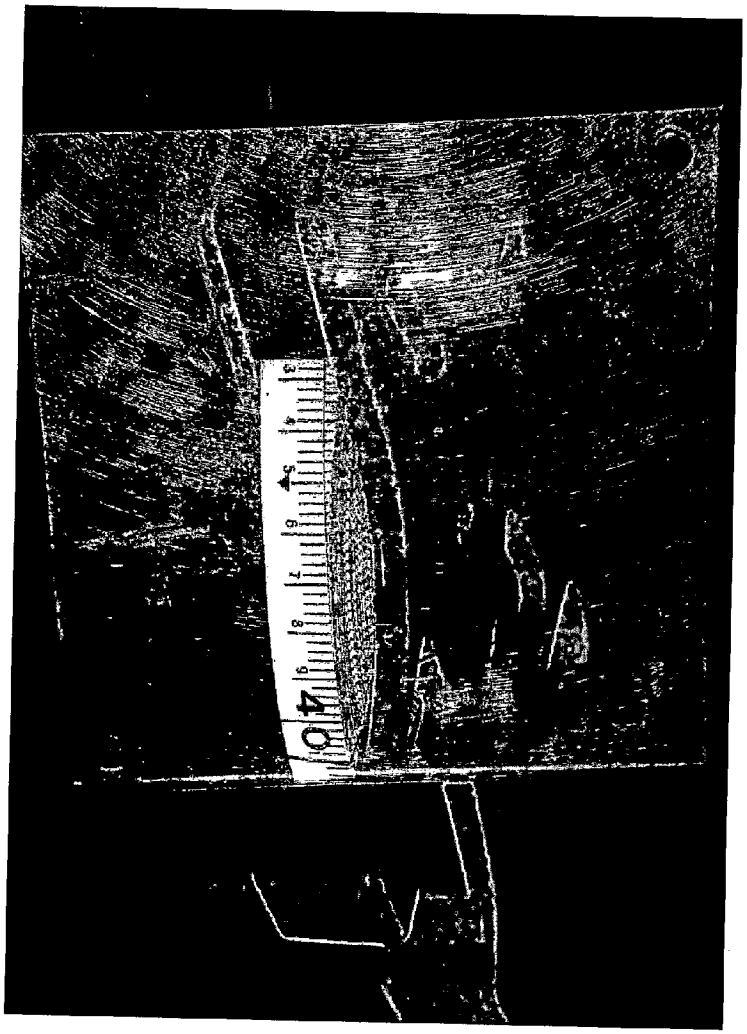
FIG. 4*b* illustrates the abrasive effect of collected water supply with concrete residue.

FIG. 4*b* illustrates an acrylic plate after 30 minutes of continuous application of pressurised water from the recycled water supply.

It is clear from the picture the abrasive effect of the recycled water. With scratch marks clearly visible in 4*b* compared to a relatively smooth surface shown in 4*a*.

Figure 5:
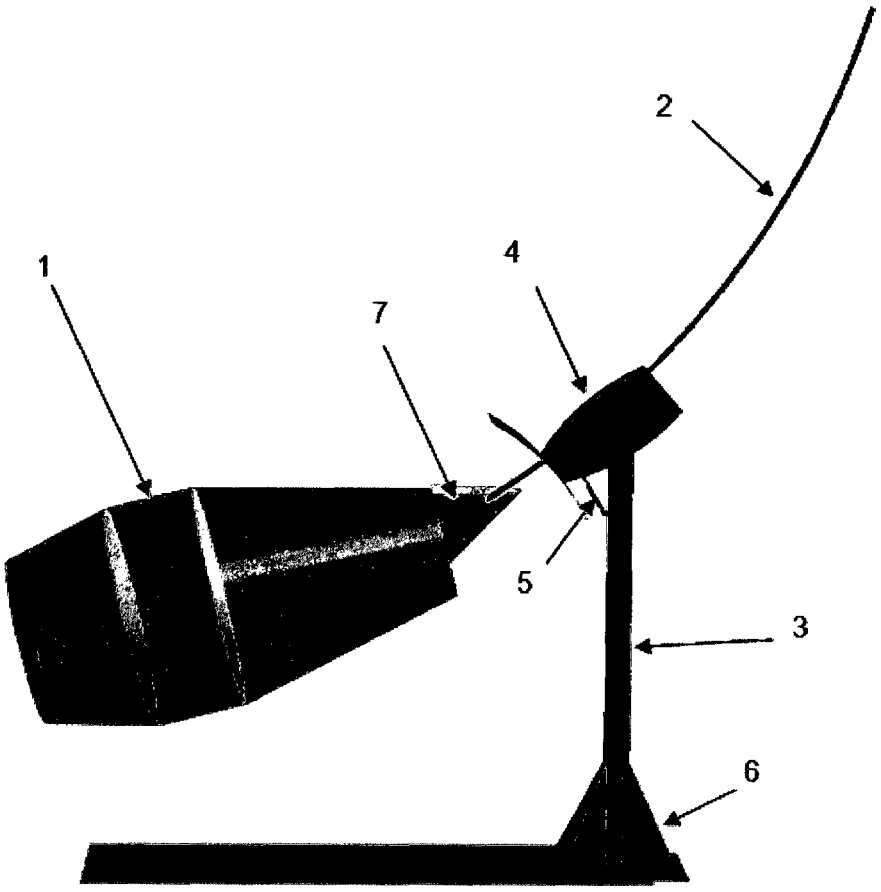
FIG. 5 illustrates an alternative concrete bowl cleaning station set up, adapted for concrete bowls with charge hoppers.

FIG. 5 illustrates an alternative concrete bowl cleaning station set up, adapted for concrete bowls with charge hoppers.

In this embodiment, the probe is configured to a substantially elongated pedestal (3) which has a well supported base (6). The pedestal (3) has the advantage that it is easily manufactured, and it takes up less room than a frame.

In this embodiment, the probe (2) is a curved hollow member which carries water nozzles configured to introduce the water into the concrete bowls.

In this embodiment, the curved probe is used for the concrete bowls (1) configured with charge hoppers (7).

In this embodiment, the curvature of the probe (2) is of a nature that the probe (2) can be inserted into the concrete bowl (1) with clearance from the charge hoppers (7), without having to physically move the charge hoppers (7).

In this embodiment, the curved probe (2) is constructed from a standard pipe.

In this embodiment, the concrete bowl (1) entry angle of the curved probe (2) is configured so that the probe (2) will clear the charge hopper (7) without having to physically move the charge hopper (7).

In this embodiment, there is a drive mechanism (4) for egress and ingress of the curved probe.

This drive mechanism (4) is a friction driver roller system incorporating a plurality of rollers. At least one of these rollers is fixed and the rest is floating in a self tightening system i.e. the grip around the pipe tightens as the load increases.

There is further provided an actuating mechanism (5) to control the angle of insertion of the curved probe. Such actuating mechanism can include a hydraulic ram, or electric motors or the like.

Aspects of the present invention have been described by way of example only and it should be appreciated that modifications and additions may be made thereto without departing from the scope thereof as defined in the appended claims.

What we claim is:

1. A method of cleaning a concrete bowl, comprising:

a) introducing water into at least one concrete bowl;

b) collecting the water from the at least one concrete bowl after it has been used; and c) cleaning the at least one concrete bowl by introducing at least some of the collected water into the at least one concrete bowl under pressure, wherein the water is introduced into the concrete bowl by a hollow, curved probe, the probe being made from standard pipe, wherein a radius of curvature of the probe is between 7 and 10 meters such that the probe can be inserted into the at least one concrete bowl with clearance from any structures of the at least one concrete bowl, wherein the probe carries water nozzles configured to introduce the water into the at least one concrete bowl.

2. The method as claimed in claim 1, wherein the recycled water is introduced into the at least one concrete bowl at a pressure of great than 1 bar and less than 20 bar.

3. The method as claimed in claim 2, wherein the recycled water is introduced into the at least one concrete bowl at a pressure of approximately 5 bar.

4. The method as claimed in claim 1, wherein the at least one concrete bowl is rotated during the cleaning process.

5. The method as claimed in claim 4, wherein the at least one concrete bowl is rotated at a speed of greater than 2.5 rpm and less than 10 rpm.

6. The method as claimed in claim 4, wherein the at least one concrete bowl is rotated at a speed of approximately 6 rpm.

7. The method as claimed in claim 1, wherein the probe ingresses at a speed of approximately 0.95 m/min.

8. The method as claimed in claim 1, wherein the probe egresses at a speed of approximately 0.95 m/min.

9. The method as claimed in claim 1, wherein the probe ingress and egress speed is greater than 0.3 m/min but no greater than 1.6 m/min.

10. A station for cleaning a concrete bowl, comprising:

a hollow, curved probe configured for introducing water into the concrete bowl;

recycling means for collecting and re-introducing the used water back into the concrete bowl; and an apparatus for supplying pressure to the recycled water, wherein the probe is made from standard pipe, wherein a radius of curvature of the probe is between 7 and 10 meters such that the probe can be inserted into the concrete bowl with clearance from any structures of the concrete bowl, and wherein the probe carries water nozzles configured to introduce the water into the concrete bowl.

11. The station as claimed in claim 10, wherein the apparatus to supply pressure to the recycled water is a pump.

12. The station as claimed in claim 10, wherein the probe includes nozzles.

13. The station as claimed in claim 12, wherein the nozzles are adjustable.

14. The station as claimed in claim 10, further comprising a user monitoring device which allows the user to monitor the status of the interior of the concrete bowl.

15. The station as claimed in claim 10, wherein the length of the probe is between 4.5 m-6.5 m.

16. The station as claimed in claim 10, wherein the probe is a curved standard pipe.

17. The station as claimed in claim 10, wherein the entry angle of the curved probe will be so that the probe will clear the charge hopper without having to physically remove the charge hopper.

18. The station as claimed in claim 10, wherein the entry angle of the probe is between 38-45 degrees.

19. The station as claimed in claim 10, wherein the probe is driven by an actuating mechanism.

20. The station as claimed in claim 19, wherein the actuating mechanism is a friction driver roller system incorporating a plurality of rollers, of which at least one of the rollers is fixed and the rest is floating in a self tightening system.

21. The station as claimed in claim 10, wherein the ingress and egress speed of the probe is in the range of 0.4 m/min to 1.5 m/min.

22. The station as claimed in claim 10, wherein the probe is constructed out of box section material.

23. The station as claimed in claim 22, wherein the probe is driven by a tooth belt system.

24. The station as claimed in claim 10, wherein the angle of insertion for the probe is adjustable via adjusting means.

25. The station as claimed in claim 24, wherein the adjusting means is a hydraulic ram.

26. A method of cleaning a concrete bowl, comprising:

a) introducing water into at least one concrete bowl;

b) collecting the water from the at least one concrete bowl after it has been used; and c) cleaning the at least one concrete bowl by introducing at least some of the collected water into the at least one concrete bowl under pressure, wherein the water is introduced into the at least one concrete bowl by a hollow, curved probe, the probe being made from box section conduit, wherein a radius of curvature of the probe is between 7 and 10 meters such that the probe can be inserted into the at least one concrete bowl with clearance from any structures of the at least one concrete bowl, wherein the probe carries water nozzles configured to introduce the water into the at least one concrete bowl.

27. A station for cleaning a concrete bowl, comprising:

a hollow, curved probe configured for introducing water into at least one concrete bowl;

recycling means for collecting and re-introducing the used water back into the at least one concrete bowl; and an apparatus for supplying pressure to the recycled water, wherein the probe is made from box section conduit, wherein a radius of curvature of the probe is between 7 and 10 meters such that the probe can be inserted into the at least one concrete bowl with clearance from any structures of the at least one concrete bowl, and wherein the probe carries water nozzles configured to introduce the water into the at least one concrete bowl.

* * * * *